US006438761B1

(12) United States Patent
McGarrity

(10) Patent No.: US 6,438,761 B1
(45) Date of Patent: Aug. 27, 2002

(54) PROTECTIVE HEADBAND FOR HEADING A BALL

(76) Inventor: Sean McGarrity, 6868 Putnam Dr., Derby, NY (US) 14047

( * ) Notice: Subject to any disclaimer, the term of this patent is extended or adjusted under 35 U.S.C. 154(b) by 0 days.

(21) Appl. No.: 09/951,808

(22) Filed: Sep. 13, 2001

(51) Int. Cl.[7] ..... A42B 1/06
(52) U.S. Cl. ..... 2/410; 2/171
(58) Field of Search ..... 2/410, 421, 425, 2/411, 414, 417, 418, 205, 423, 412, 171, 200.1, 209.3, 209.4, 209.5, 209.7, 413, 181, 183, DIG. 11

(56) References Cited

U.S. PATENT DOCUMENTS 4,698,852 A * 10/1987 Romero ..... 2/171
4,910,804 A * 3/1990 Lidgren ..... 2/181.8
4,947,488 A * 8/1990 Ashinoff ..... 2/181
5,377,360 A * 1/1995 Fleitman ..... 2/171
5,930,841 A 8/1999 Lampe et al.
5,946,734 A 9/1999 Vogan
5,963,989 A 10/1999 Robertson
6,000,062 A 12/1999 Trakh
6,266,826 B1 * 7/2001 Alfano ..... 2/411

* cited by examiner

*Primary Examiner*—Danny Worrell
*Assistant Examiner*—Gary L. Welch
(74) *Attorney, Agent, or Firm*—Hodgson Russ LLP

(57) ABSTRACT

Generally, the present invention relates to an improved headguard to be worn by soccer players that protects the forehead during the act of heading the soccer ball without compromising the integrity of the game. In its preferred embodiment, the protection device cushions the forehead through a combination of soft padding and a custom molded plastic insert. Preferably, the custom molded rigid polymeric insert is sandwiched between two layers of padded, elastic fabric in the form of a headband surrounding the forehead. Since the custom molded insert is housed between two fabric layers, it poses no hazard to the wearer or other players.

18 Claims, 3 Drawing Sheets

PROTECTIVE HEADBAND FOR HEADING A BALL

BACKGROUND OF THE INVENTION

1. Background of the Invention

This invention relates generally to protection and sports training devices and, more specifically, to a device that protects the forehead of a soccer player during the act of "heading" a soccer ball. In its preferred embodiment, the protection device cushions the forehead through a combination of soft padding and a custom molded plastic insert. Preferably, the custom molded rigid polymeric insert is sandwiched between two layers of padded, elastic fabric in the form of a headband surrounding the forehead. Since the custom molded insert is housed between two fabric layers, it poses no hazard to the wearer or other players.

2. Prior Art

"Heading" of a soccer ball, defined as the intentional act of directing the soccer ball with the forehead, is an integral skill that soccer players must master in order to participate fully in their sport. In fact, soccer is the only sport where the flight path of the object projectile is skillfully and accurately altered with the forehead. The proper technique for heading the soccer ball, as it is taught to all soccer players, is to use only the forehead region, approximately an area between the eyebrows and hairline in the vertical dimension, and between the most forward portion of the temples in the horizontal dimension. Unfortunately, recent studies have shown that repeated collision of the forehead with a soccer ball can cause serious damage to brain tissue and lead to permanent brain damage and subsequent decreased cognitive functioning in soccer athletes: (Tysvaer A T, Lochen, E A: Soccer Injuries to the Brain, a neurophysiologic study of former soccer players, American Journal of Sports Medicine 19:56–60 (1991); Sortland 0, Tysvaer, A T: Brain Damage in Former Association Football Players, An Evaluation by Cerebral Computed Tomography, Neuroradiology 31: 44–48, (1989); and Tysvaer A T, Storli 0 V: Soccer Injuries to the Brain, A neurologic and Electroencephalographic Study of Active Football Players, American Journal of Sports Medicine 17:573–578, (1989)). This would be especially apparent in practice situations, where the players repeatedly head the ball in order to develop this skill.

Several devices have been developed that are intended to protect the forehead of the player during the intentional act of heading a soccer ball with the forehead. These headband devices utilize either soft padding alone, or a combination of soft padding and rigid plastic that is not custom-molded. Devices utilizing soft padding alone are taught in U.S. Pat. No. 5,930,841 to Lampe et al.; U.S. Pat. No. 5,946,734 to Vogan; and U.S. Pat. No. 6,000,062 to Trak. However, there are several disadvantages to such devices. First, soft padding absorbs and attenuates less impact than a rigid member. In order for soft padding head protectors to provide adequate protection, they must be relatively thick and obtrusive, having a profile similar to boxing headgear. This type of protective device would prohibit a player from heading the ball accurately. Secondly, soft padding decreases the rebound of the ball off of the forehead, and thus decreases the speed of the ball. A reduction in rebound speed alters the integrity of soccer by slowing the ball through a dampening of the impact. It is known that soccer players will attempt to compensate for this dampening by increasing the impact between their forehead and the ball through acceleration of their head forward by a snapping motion of the neck. This increases the force of impact and negates the effect of the soft padding while at the same time exposing the neck to harmful stretch forces similar to those seen in whiplash. In summary, a soft padding protective head device absorbs less impact than a rigid protective member, and this compromises accurate ball placement, decreases the rebound of the ball off of the forehead, and potentially exposes the neck to harmful forces.

U.S. Pat. No. 5,963,989 to Robertson relates to a rigid member for protecting the forehead from contact with a ball. However, this rigid protector is not custom fitted to the wearer and, therefore, does not provide the most accurate ball placement possible.

Therefore, the prior art does not adequately satisfy the requisite criteria for a soccer player wearing a protective head device. These include the requirement that the device be effective in protecting the forehead of the wearer while at the same time maintaining accurate ball placement and rebound speed, be of a low profile, unobtrusive, comfortable, and aesthetically acceptable to young wearers. As such, there has been considerable resistance to wearing protective head devices due to their tendency to prohibit accurate ball placement and to dampen the rebound speed of the ball off of the forehead. The prior art protection devices having rigid protection members that do not conform to the exact contour of the forehead sacrifice accuracy, and those that use soft materials that dampen impact and slow the ball compromise game. speed.

SUMMARY OF THE INVENTION

Accordingly, the disadvantages of the prior art are overcome through the protection device of the present invention comprising an adjustable head band housing a custom-molded polymeric insert as a head plate. The use of a headband protector comprising a custom contoured rigid polymeric insert is an improvement over the prior art that ensures the most accurate ball control possible. The rigid contoured insert also enables the wearer to maintain a high rebound speed without exposing the head and neck to undue trauma. Thus,. the goal of shock absorption is accomplished without compromising the integrity of the game by preserving the speed and aim accuracy of the headed ball. Consequently, soccer players will be more receptive to wearing such a protection device if they are able to head the ball as effectively as if they were not wearing a head protector at all.

DETAILED DESCRIPTION OF THE PREFERRED EMBODIMENTS

Figure 1:
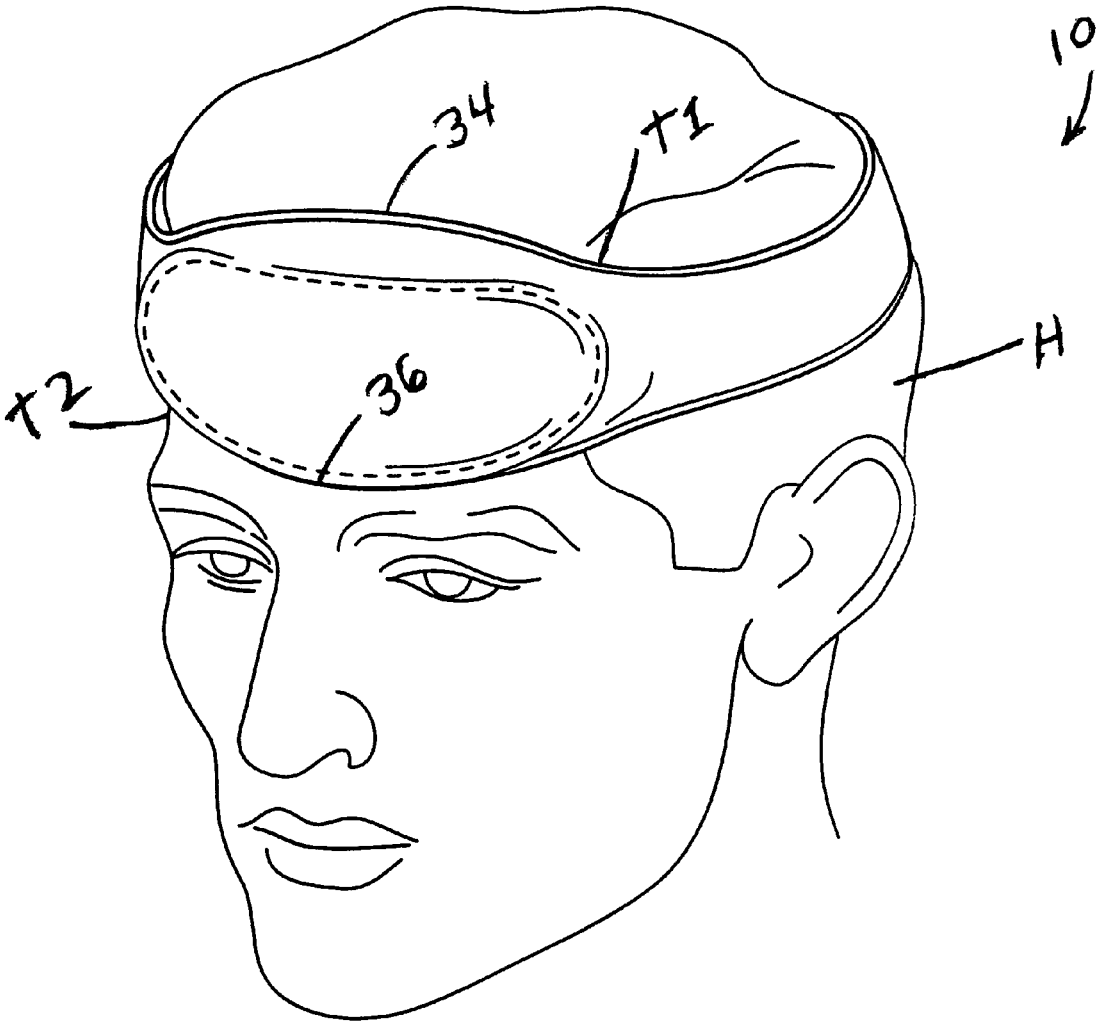
FIG. 1 is a perspective view of a protection device 10 of the present invention being worn by a person about the head.
Figure 2:
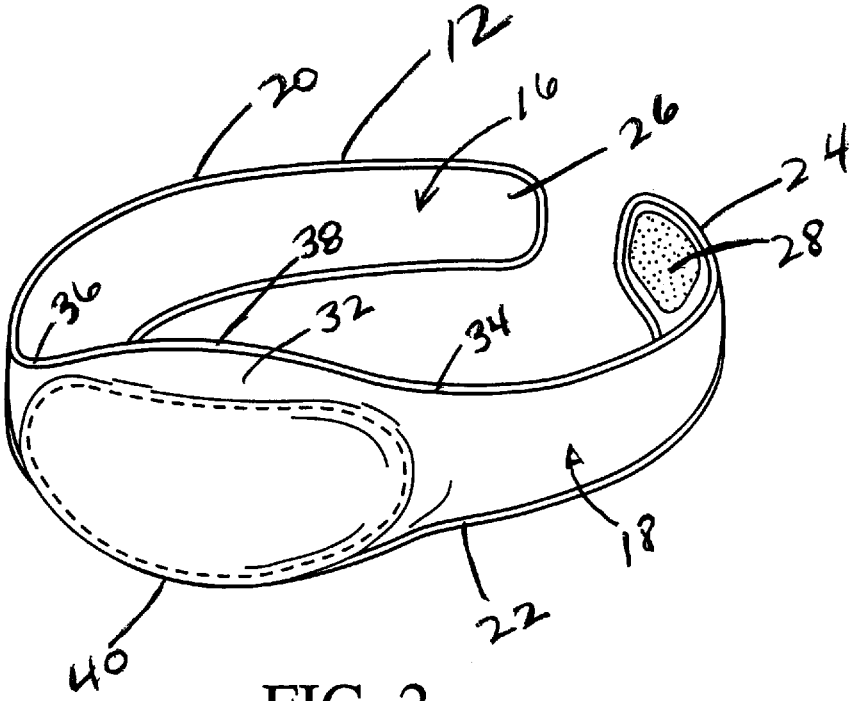
FIG. 2 is a front perspective view of the protection device 10.
Figure 3:
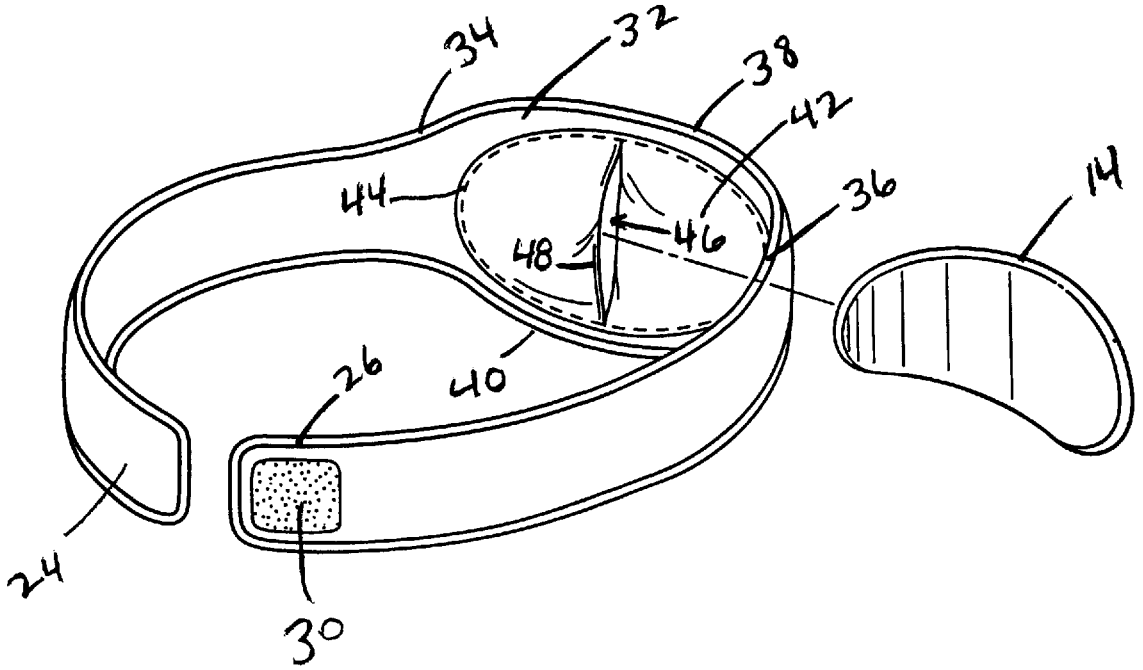
FIG. 3 is a back perspective view of the protection device 10.

Turning now to the drawings, FIGS. 1 to 3 show one preferred embodiment for a protection device 10 according to the present invention. The protection device 10 generally comprises a narrow strip in the shape of a headband 12 housing a polymeric insert 14 (FIG. 3). The headband 12 is a relatively soft member made of a cloth or fabric material, for example neoprene. The headband 12 has an inner surface 16 and an opposed outer surface 18, both extending to and meeting with an upper edge 20 and a lower edge 22. The inner and outer surfaces 16, 18 and the upper and lower edges 20, 22 each extend to a first end 24 and a spaced apart second end 26. This structure provides the headband 12 with a significantly greater length between the ends 24 and 26 than its width between the upper and lower edges 20 and 22. A particularly preferred material is commercially available from All Med Inc. under the trade name NEO-PLUSH. This material is somewhat elastic.

The inner surface 16 at the first end 24 supports a first pad 28 (FIG. 2) of one of a hook and a loop type-fastener while the outer surface 18 at the second end 26 supports a second pad 30 (FIG. 3) of the other of the fastener combination. An exemplary type of hook and loop fastener is marketed under the VELCRO trademark. The length of the headband 12 is sufficient to surround a user's head H with the ends 24, 26 overlapping to contact the first pad 28 with the second pad 30 to engage the loops to the hooks of the fastener to secure the headband 12 about the head. Preferably, the headband 12 has a length to surround various sized heads.

The width of the headband 12 between the upper and lower edges 20 and 22 and extending from both ends 24, 26 to a central portion 32 are of an equal height. The central portion 32 is bordered by right and left temple portions 34 and 36, coinciding approximately with the right and left temples T1, T2 of the user's head. There, the headband widens somewhat with the upper and lower edges 20, 22 having reflective upper and lower curved portions 38 and 40, respectively.

An oval-shaped backing member 42 is sewn 44 or otherwise secured to the inner surface 16 of the headband 12 aligned with the central portion 32. In that manner, the backing member 42 is positioned at a central location between the left and right temple portions 34, 36, and provides a pocket 46 with the headband 12. A vertically oriented slit 48 runs from a position adjacent to the upper edge 20 to a position adjacent to the lower edge 22 and provides access to the pocket 46.

The rigid polymeric insert 14, which is commercially available under the trademark ORTHOPLAST (Johnson & Johnson), is cut to match the oval shape of the pocket 46. To form the shaped inset 14, it is first immersed in 160° F. water to soften it into a malleable state. The softened plastic is then pressed directly against the user's forehead for about two minutes. Once cooled and hardened, the inset 14 is permanently shaped to match the exact contour of the user's forehead.

The custom molded polymeric inset 14 is then inserted through the slit 48 to a position between the, headband 12 and the backing member 42. The stitching 44 is positioned to allow only so much room in the pocket 46 as is needed to snuggly house the insert 14 without allowing the insert to move freely in the pocket. The headband 12 is then positioned about the user's head with the slit 48 centered along the forehead. The ends 24, 26 are brought together to contact the hook and loop pads 28, 30 to each other to secure the protection device 10 in place.

While the present protective device 10 has been described as comprising a headband 12 with a sewn in backing member 42, an alternate embodiment has two cloth or fabric strips sewn together. In this case, the two cloth strips are sewn together about their entire coinciding peripheries, and at a position adjacent to their coinciding central portions 32 to provide the pocket 46. The inner cloth strip has the slit 48 for receiving the inset 14. Alternatively, a cloth of double width is folded in half width wise to form the double thickness headband.

Figure 4:
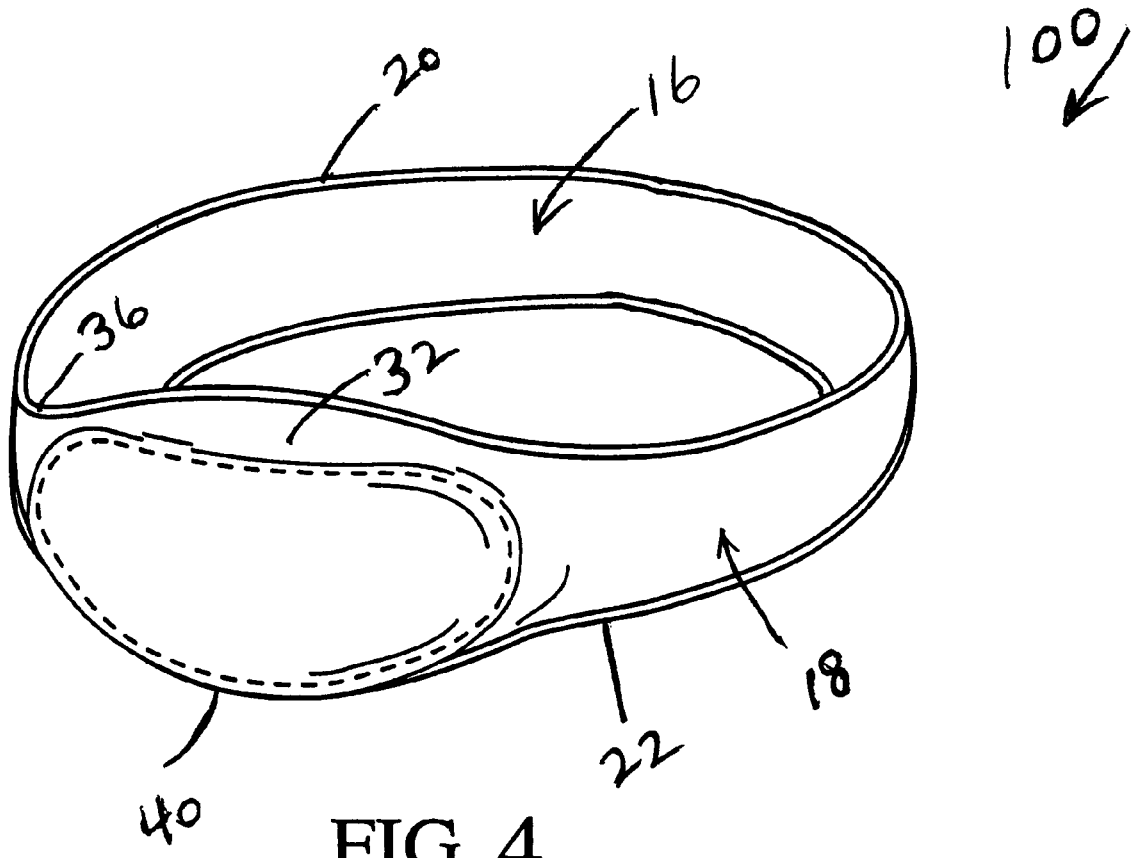
FIG. 4 is a perspective view of an alternate embodiment of a protection device 100 according to the present invention.

FIG. 4 shows an alternate embodiment of a protective device 100 according to the present invention. This device is constructed as an endless member made of a stretchable fabric. In that respect, protective device 100 does not have spaced apart ends which are secured together. Instead, it is sized so that the fabric stretches somewhat to provide a comfortable, snug fit about the user's head. In all other respects, the protective device 100 is the same as the previously described protective device 10.

Still further, instead of the headband 12 having the slot 48 in the backing member 42 secured to the inner surface 16 thereof, the two cloth construction provides for housing the shaped insert 14 in place by various alternate methods. These include having the cloths separate from each other at then coinciding peripheries to provide access to a pocket between them. The cloths could separate at either the upper edge 20 or the lower edge 22. Then, once the insert 14 is in place, the cloths are secured to each other, such as by VELCRO, to close the pocket.

Those skilled in the art will also realize that the insert 14 can be provided in positions other than to protect the forehead. For example, the headbands 10, 100 could be provided with pockets at various positions about their peripheral extent. That way, an insert could be provide to protect the temples or the back of the head as well as the forehead.

Alternate embodiments of the present invention also include the backing member 42 or inner one of the coinciding cloth strips being of a perspiration absorption fabric such as Terry cloth. Also, the polymeric insert 14 can be perforated for ventilation purposes. Furthermore, those skilled in the. art will readily recognize alternate fastener devices in addition to the described hook and loop type fastener. These alternate structures include snaps, buttons, buckles, and repositionable adhesives. Still further, the insert 14 can be secure to the inside of the headbands 10, 100 by means other than the pocket. These alternate structures include VELCRO type fasteners, snaps, repositionable tape, and the like.

Thus the scope of the invention should be determined by the appended claims and their legal equivalents, rather than by the example given in the drawings.

What is claimed is:

1. A protective device that protects the forehead of a soccer player when the forehead is used to redirect a soccer ball, the protective device comprising:

(a) a fabric strip provided with a length sufficient to encircle the head and covering approximately from temple to temple and eyebrow to hairline;

(b) a backing member secured to a back side of the fabric strip to provide an intermediate cavity formed between the fabric strip and the backing member, the cavity generally coinciding with the forehead;

(c) an access opening into and through the backing member and in communication with the cavity, wherein the backing member comprises first and second portions having respective first and second edges disposed proximate to each other in a closed position but unsecured to each other and unsecured to the fabric strip to provide ready access to the cavity when the first and second edges are moved away from each other and into an access position; and (d) a thin polymeric insert positionable into and removable from the cavity through the access opening when the first and second edges of the first and second portions of the backing member are moved into the access position, and wherein the polymeric insert is housed in the cavity with the first and second edges in the closed position.

2. The protective device of claim 1 wherein the fabric strip has spaced apart first and second ends provided with a fastener device to secure the fabric strip encircling the head.

3. The protective device of claim 2 wherein the fastener device is selected from the group consisting of a hook and loop type fastener, a snap, a button, a buckle and a repositionable adhesive.

4. The protective device of claim 1 wherein the cavity is formed by two fabric strips secured together at least at a position coinciding with the forehead of the user.

5. The protective device of claim 1 wherein the polymeric insert is formable into the exact shape of the user's forehead.

6. The protective device of claim 1 wherein the polymeric insert is perforated.

7. The protective device of claim 1 wherein the fabric strip is endless and of a stretchable material capable of fitting snuggly about the user's forehead.

8. The protective device of claim 1 wherein at least that portion of the fabric strip which contacts the forehead is of perspiration absorption material.

9. The protective device of claim 1 wherein the cavity is formed in the back side of the fabric strip.

10. A protective device that protects a portion of a head, the protective device comprising:

(a) a fabric strip provided with a length sufficient to encircle the head and covering approximately from temple to temple and eyebrow to hairline;

(b) a backing member secured to a back side of the fabric strip to provide an intermediate cavity formed between the fabric strip and the backing member, the cavity generally coinciding with the area to be protected;

(c) an access opening into and through the backing member and in communication with the cavity, wherein the backing member comprises first and second portions having respective first and second edges disposed proximate to each other in a closed position but unsecured to each other and unsecured to the fabric strip to provide ready access to the cavity when the first and second edges are moved away from each other and into an access position; and (d) a thin polymeric insert positionable into and removable from the cavity through the access opening when the first and second edges of the first and second portions of the backing member are moved into the access position, and wherein the polymeric insert is housed in the cavity with the first and second edges in the closed position.

11. A method for providing a protective device that protects the forehead of a soccer player when the forehead is used to redirect a soccer ball, comprising the step of:

a) providing a polymeric member sized to cover the forehead;

b) heating the polymeric member to a malleable state;

c) contacting the malleable polymeric member to the forehead to shape the polymeric member;

d) providing a fabric strip having a length sufficient to encircle the head and covering approximately from temple to temple and eyebrow to hairline, wherein the fabric strip has a cavity formed therein and positioned generally coinciding with the forehead, the fabric having an access opening in communication with the cavity;

e) inserting the shaped polymeric member into the cavity through the access opening; and f) securing the fabric strip about the user's head with the shaped polymeric member positioned over the forehead.

12. The method of claim 11 including providing the fabric strip having spaced apart first and second ends provided with a fastener device to secure the fabric strip encircling the head.

13. The method of claim 12 including selecting the fastener device from the group consisting of a hook and loop type fastener, a snap, a button, a buckle and a repositionable adhesive.

14. The method of claim 11 including forming the cavity by a backing member secured to the back side of the fabric strip.

15. The method of claim 14 including providing the fabric strip as endless member of a stretchable material capable of fitting snuggly about the user's forehead.

16. The method of claim 14 including providing at least that portion of the fabric strip which contacts the forehead of perspiration absorption material.

17. The method of claim 11 including forming the cavity by two fabric strips secured together at least at a position coinciding with the forehead of the user.

18. The method of claim 11 including providing the polymeric insert being perforated.

* * * * *